US005186368A

United States Patent [19]

Garcia

[11] Patent Number: 5,186,368

[45] Date of Patent: Feb. 16, 1993

[54] SHUTTER FOR THE OUTLET CHANNEL OF A DISPENSER HEAD FOR SEMI-LIQUID SUBSTANCES, AND A DISPENSER HEAD ADVANTAGEOUSLY ASSOCIATED THEREWITH

[75] Inventor: Firmin Garcia, Evreux, France

[73] Assignee: Valois, Le Neubourg, France

[21] Appl. No.: 609,684

[22] Filed: Nov. 6, 1990

[30] Foreign Application Priority Data

Nov. 7, 1989 [FR] France ..... 89-14593

[51] Int. Cl.[5] ..... B65D 25/40

[52] U.S. Cl. ..... 222/490; 222/380; 222/383; 222/494

[58] Field of Search ..... 222/321, 380, 383, 385, 222/490, 494

[56] References Cited

U.S. PATENT DOCUMENTS

| | | | |
|---|---|---|---|
| 849,243 | 4/1907 | Hull | 222/490 |
| 1,739,871 | 12/1929 | Smith | 222/490 |
| 2,670,884 | 3/1954 | Swartz | 222/490 |
| 3,820,698 | 6/1974 | Franz | 222/321 X |
| 3,964,509 | 6/1976 | Daubenberger et al. | 222/490 X |
| 4,930,670 | 6/1990 | Kuo | 222/385 X |

FOREIGN PATENT DOCUMENTS

| | | | |
|---|---|---|---|
| 251478 | 1/1967 | Austria | 222/490 |
| 1046518 | 10/1966 | United Kingdom | 222/490 |

OTHER PUBLICATIONS

"Duckbills", Vernay Laboratories Inc. Publication.

*Primary Examiner*—Andres Kashnikow
*Assistant Examiner*—Joseph A. Kaufman
*Attorney, Agent, or Firm*—Sughrue, Mion, Zinn, Macpeak & Seas

[57] ABSTRACT

Dispenser heads for semi-liquid substances such as cosmetic or pharmaceutical creams generally comprise a dispenser valve capped by an actuating pusher. The substance is then dispensed through an orifice provided in the surface of the pusher and which is in communication with the valve via an outlet channel. Unless additional precautions are taken, the volume of substance filling the channel after first use of the pump may be degraded by coming into contact with ambient air, thereby degrading the quality of subsequent dispensing operations, or even making them impossible. The present invention avoids this difficulty by the use of a shutter constituted by a part made of resiliently deformable material having an end wall with an inside surface and an outside surface and a side wall extending from the inside surface of the end wall, the end wall having a slot passing through it which narrows in a slit at the outside surface. The shutter is moreover engaged in a housing provided in the dispenser head in such a manner that:

1) the slot communicates with the outlet channel,
2) the head is in sealed contact with a portion of the inside surface as well as at least one side of the shutter side wall.

3 Claims, 4 Drawing Sheets

FIG.2
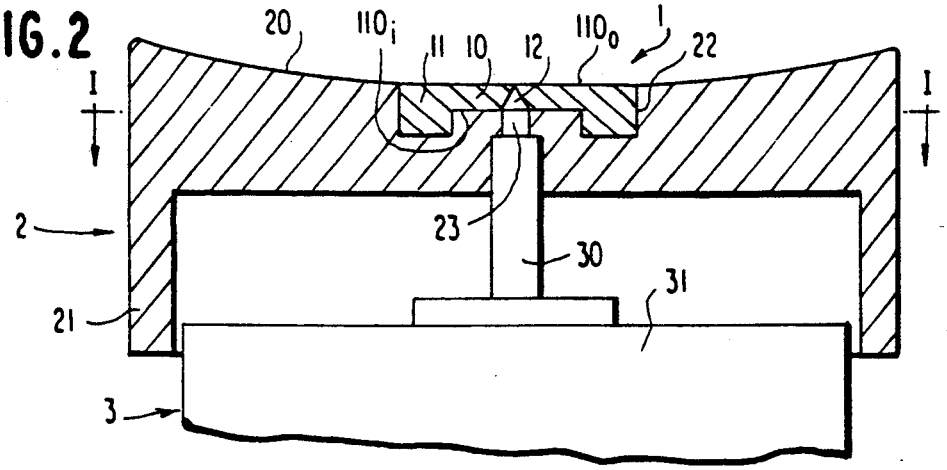
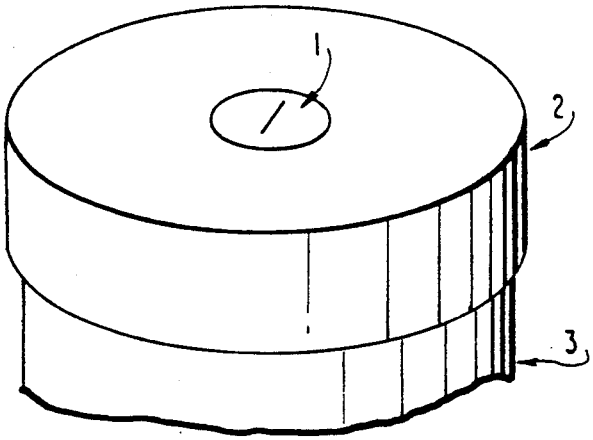
FIG.1
FIG.3
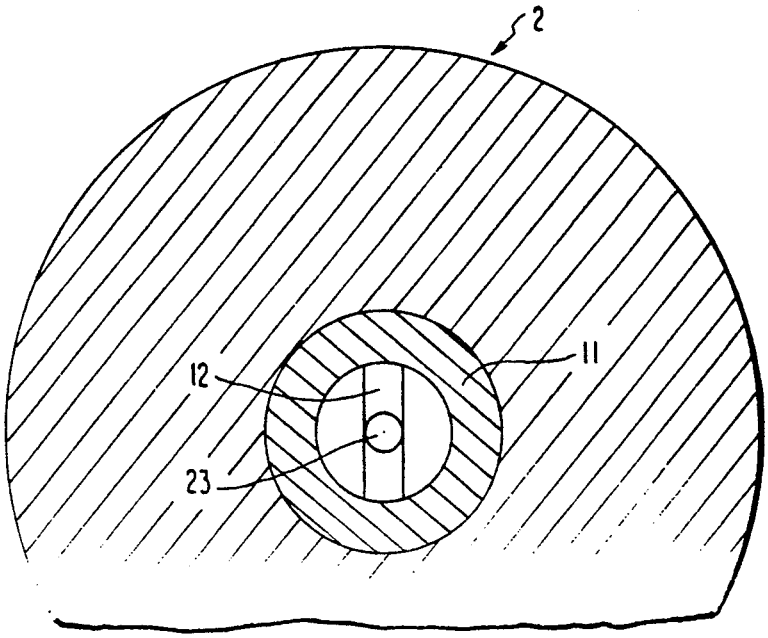

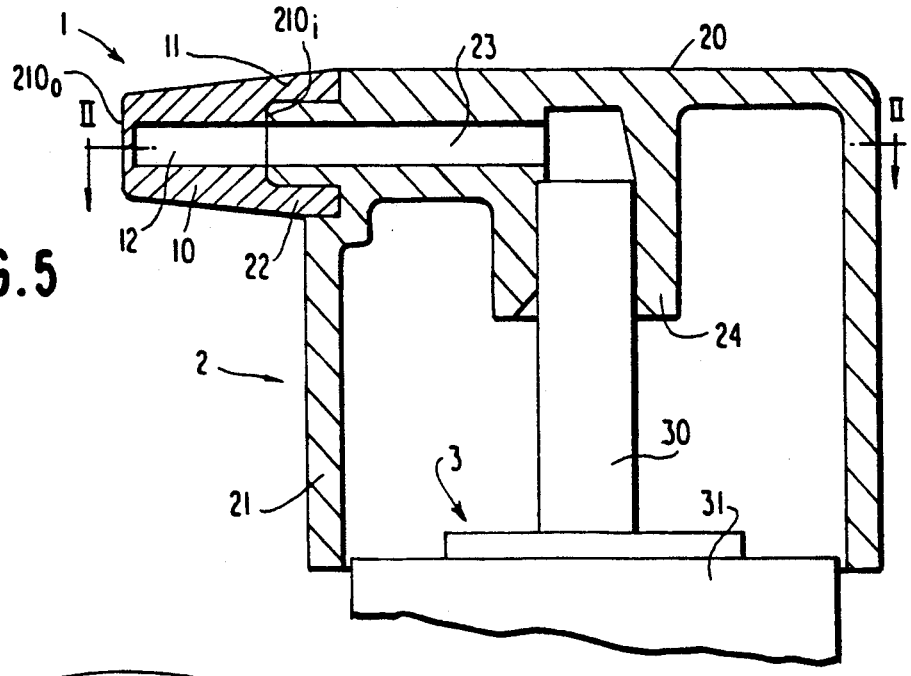
FIG.5
FIG.4
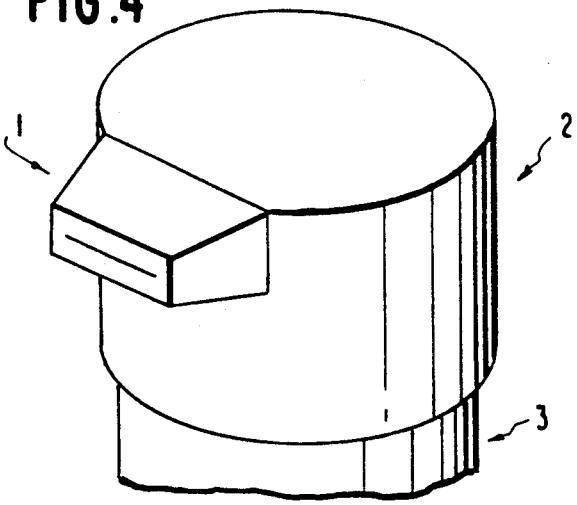
FIG.6
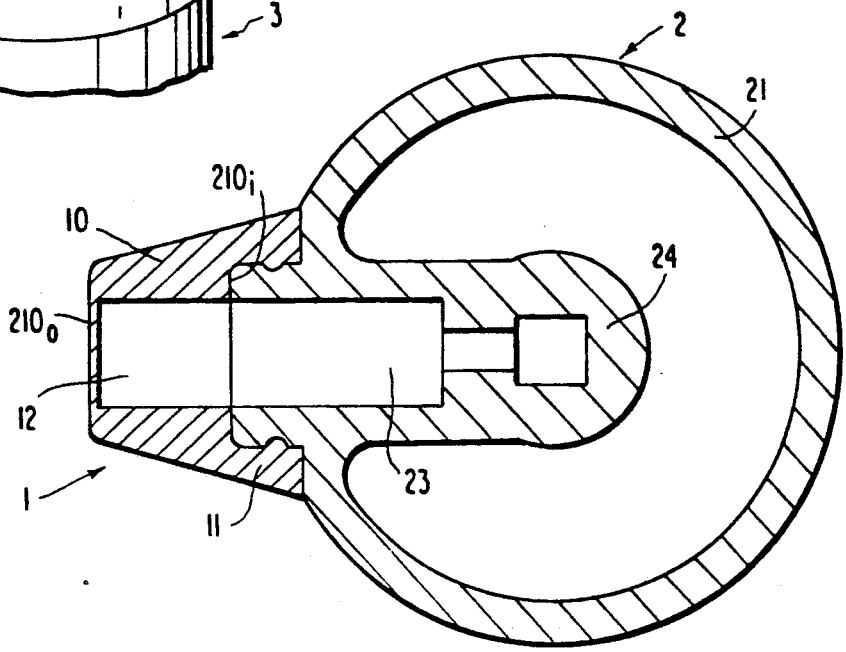

SHUTTER FOR THE OUTLET CHANNEL OF A DISPENSER HEAD FOR SEMI-LIQUID SUBSTANCES, AND A DISPENSER HEAD ADVANTAGEOUSLY ASSOCIATED THEREWITH

The present invention relates to a shutter for the outlet channel of a dispenser head for semi-liquid substances and also to a dispenser head advantageously associated with the shutter.

BACKGROUND OF THE INVENTION

It is common practice to dispense semi-liquid substances such as creams, lotions, or pastes by means of a metering pump mounted in sealed manner on a supply of such a substance and actuated by means of a pusher. This provides numerous advantages in the food industry, the pharmaceutical industry, or even in the cosmetic industry, with the advantages including the possibility of dispensing predetermined quantities, guaranteeing clean delivery, facilitating emptying of the supply, . . . . However, problems remain which are related to the conventional design of dispenser heads constituted by a pusher and a pump.

The pump generally communicates with a delivery orifice formed in the pusher by means of a channel situated downstream from the outlet valve of the pump chamber. Thus, once the head has been actuated for the first time, this channel is filled with substance. The quantity of substance occupying the corresponding dead volume is thus in contact with ambient air. If there is a pause of any length of time before the next actuation, then the substance retained in this way begins to dry and harden. The dispenser then becomes unusable since the contents of the outlet channel block the path to the outside. Depending on the nature of the substance, other difficulties may also be expected with this volume exposed to the air. For example, the substance therein may oxidize and lose its properties. If the substance is a medicine, contamination by the bacteria present in the water vapor of the environment may make the substance harmful.

In order to avoid these problems, various systems have been proposed. Some consist in removing all of the substance remaining in the outlet channel at the end of head actuation. This is achieved in the prior art, for example, by forcing the contents of the channel into an intermediate chamber which is closed by a valve which allows flow to take place in both directions. The valve is then advantageously constituted by a relatively resilient disk provided with one or two small slots. Other systems seek to close the delivery orifice itself as soon as a dose of substance has been delivered. To this end, European patent application EP-A-0 129 643 filed in 1984 by Pfeiffer has a needle which is fixed to a pair of pistons. The needle occupies the outlet channel and in the rest position it co-operates with the delivery orifice which then acts as a valve seat, whereas during dispensing, the pressure of the substance causes the pair of pistons to retract into the channel.

These prior inventions suffer from the drawback of giving rise to parts which are relatively complex in shape: in one case an intermediate chamber with a valve, and in the other case a pair of pistons. Unfortunately, these parts are very small in size since they have to occupy the outlet channel of a dispenser head (no more than a few millimeters). Consequently they are expensive to make. In any event, the operation of this type of internal valve is unreliable.

French patent FR 1 539 302 avoids this type of drawback by taking advantage of the deformability of a flexible shutter. However it is implemented by means of a resilient "sheet" or "membrane" disposed in front of the dispensing head outlet and perforated by a hole or a slit. So long as the membrane is retained by a ring wedged in the bottom of a cylindrical housing formed in the head, then the substance delivered under pressure distends the membrane and its hole or slit is thus opened. When the pressure is removed, the lips of these perforations come back practically into contact. Although the simple operating principle ensures that closure takes place effecively, installing such a membrane is difficult and hardly compatible with maintaining the production rates that are required if such dispensing heads are to be reasonably priced.

The present invention therefore seeks to avoid problems relating to a volume of substance remaining in the outlet channel and exposed to air, but by means of a part which is simple in shape and which enables a dispenser head to be made for semi-liquid substances which is both cheap and reliable.

SUMMARY OF THE INVENTION

The present invention provides a shutter for an outlet channel of a dispenser head particularly adapted for delivering a semi-liquid substance at a pressure greater than atmospheric pressure, said shutter being made of a resiliently deformable material and including a perforation having lips that press against each other in sealed manner at rest, wherein said shutter has an end wall with an inside surface and an outside surface, and a side wall extending from said inside surface of said end wall, said perforation being formed through said end wall and being constituted by a slot having its maximum width adjacent said inside surface and narrowing to a slit adjacent said outside surface, and said shutter is engaged in a housing formed in said head in such a manner that:

1) said slot communicates with said outlet channel, said slit being at the outside of said dispenser head such that said substance dispensed under pressure exerts a force on the walls of said slot, thereby deforming the shutter and causing the slit to open; and 2) said head is in sealed contact with said side wall over a first surface and is in sealed contact with said end wall over a second surface, said first and second surfaces being such that no communication is possible between said outlet channel and the outside via said shutter other than through said perforation.

Advantageously, said housing is deeper than the corresponding dimension of said side wall such that said first and second contact surfaces are established when said shutter is fully engaged in said housing.

For example, said shutter is a part made of a thermoplastic elastomer.

Although it is preferable for the maximum width of said slot to be equal to the diameter of said outlet channel, its width may be reduced to a slit on the outside surface, with reduction taking place linearly or suddenly. The slit may be rectilinear or cruciform. Similarly, said side wall may define an enclosure which is circular or rectangular in section.

Other embodiments can also be envisaged. For example, said housing may engage both the inside and the outside surfaces of said side wall, or it may engage the outside surface only, or it may engage the inside surface only. Similarly, the surface of said end wall making sealed contact with said head may be within said side wall or around it.

There is no need to underline that such a shutter is well adapted for the intended purpose. It merely constitutes a small stopper disposed at the free end of the outlet channel. Because of the flexibility of the material from which it is made, its slit isolates the channel when at rest. However, as soon as substance under a small amount of pressure flows into the channel and penetrates into the slot of the shutter, then the slot deforms so that its slit opens. In other words, the shutter constitutes a non-return valve which is particularly simple both in shape and in operation. This makes it highly reliable. It also constitutes a part which is relatively robust and is easily assembled to the dispenser head merely by being fitted on to the remainder of the head, which fitting operation is facilitated by the flexibility of the material from which the shutter is made.

The present invention also provides a dispenser head constituted by associating such a shutter with:

a dispenser valve including means for fixing it to a supply of said substance and a hollow rod suitable for being thrust into said fixing means in order to open said dispenser valve, said substance then flowing into said hollow rod at a pressure greater than atmospheric pressure; and a pusher suitable for engaging said hollow rod of said dispenser valve so that said hollow rod communicates with said outlet channel and is in abutment therein when pushed down, said housing then being provided in said pusher at the free end of said outlet channel.

Advantageously, said dispenser valve is a metering pump whose pump chamber preferably accepts said shutter as its own outlet valve. For example, said dispenser valve may further include a pump body communicating with said supply via an admission non-return valve, said hollow rod being fixed to a piston suitable for travelling in sealed manner within said pump body against the return force of resilient return means, said piston being hollow so that said pump body is in permanent communication with said outlet channel, thereby defining a pump chamber suitable for accepting said shutter as its outlet valve.

Dispenser heads of this nature are naturally advantageous when it is necessary to solve the problem of substance remaining in the outlet channel becoming spoiled. Under such circumstances, the shutter of the invention means that there is no need to provide an outlet valve for the pump mechanism of the dispenser valve. This facilitates manufacture of said pump mechanism. To be convinced of this, it suffices to consider a pump of the type described in German patent DE 2 840 110 filed in 1978 by Valois. Its outlet valve makes use of a small lateral duct formed in the hollow rod. Making such a duct requires molds that are relatively complex.

BRIEF DESCRIPTION OF THE DRAWINGS

Embodiments of the invention are described by way of example with reference to the accompanying drawings, in which:

FIGS. 1 to 3 show a first embodiment of the present shutter, with the shutter being shown in association with the corresponding dispenser head, FIG. 1 being a perspective view, FIG. 2 an axial section, and FIG. 3 a horizontal section on a plane I—I of FIG. 2;

FIGS. 4 to 6 show a second embodiment of the present shutter which is shown in association with the corresponding dispenser head, FIG. 4 being a perspective view, FIG. 5 an axial section, and FIG. 6 a horizontal section on plane II—II of FIG. 5;

In these various figures, identical or similar reference numbers are given to corresponding portions of parts that perform comparable functions.

DETAILED DESCRIPTION

Figure 7:
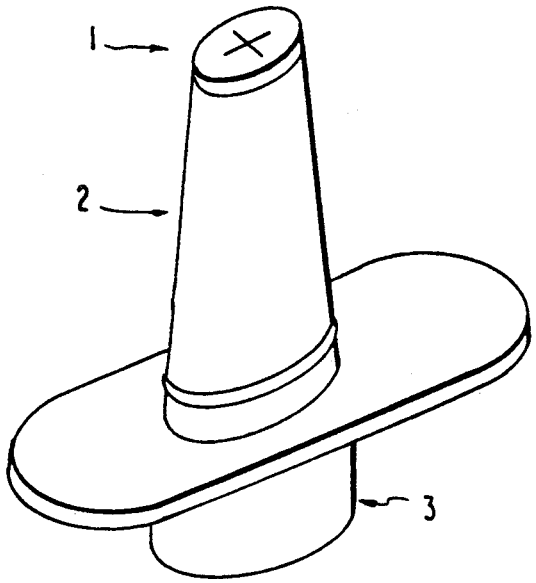
FIGS. 7 and 8 show a third embodiment of the present shutter which is shown in association with the corresponding dispenser head, FIG. 7 being a perspective view and FIG. 8 an axial section.

FIG. 1 is a perspective view of a dispenser, showing only the head thereof. It comprises a pusher 2 capping a dispenser valve 3. The structure of the dispenser valve 3 is not given in greater detail immediately below in this description. In the axial section of FIG. 2, the valve is merely shown in side view. Initially it suffices to observe that the valve 3 includes fixing means 31 such as a crimping ring for fixing the valve in sealed manner on a supply of substance (not shown). As shown in FIG. 2, when the dispenser head is at rest, a hollow rod 30 emerges from the valve. When the hollow rod is pushed back into the means 31, the valve 3 is opened and substance is dispensed via the rod 30.

The pusher 2 is designed to fit on the valve 3. FIG. 2 shows that the pusher receives the rod 30 in an axial recess. The recess narrows down to a short outlet channel 23, thereby providing an abutment for the rod 30. The pusher 2 also includes a thrust surface 20 and a skirt 21 which serves to guide the pusher, for example along the valve fixing means 31. A user presses on the thrust surface 20 with the fingers in order to push the pusher 2 against the valve 3, thereby actuating the dispenser head.

Although the above is entirely conventional, the present invention provides for placing a special shutter 1 at the free end of the outlet channel 23 of the pusher 2. This shutter is a small piece of resiliently deformable material, preferably a thermoplastic elastomer, having an end wall 10 and a side wall 11. In the first embodiment of the present shutter as shown in FIGS. 1 to 3, the side wall is cylindrical, short, but thicker than the end wall 10. The end wall has a slot 12 passing through it and two parallel lips of the slot are chamfered. The widest part of the slot 12 is in the face **110*i* of the end wall 10 that lies within the side wall 11, whereas on the other side 110*o* of the end wall 10**, the slot is reduced to a slit and the flexibility of the material ensures that it closes in sealed manner when at rest.

The thrust surface 20 of the pusher 2 has a housing 22 adapted to receive the shutter 1 so that its side wall 11 fits in the pusher 2 and the side **110*o* of its end wall 10 including the slit is level with the thrust surface 20. The housing 22 is centered on the outlet channel 23 of the pusher 2. Thus, once the shutter 1 has been fitted to the pusher 2, its slot 12 faces the channel 23 as can be seen more clearly in FIG. 3 (which is a section on plane I—I of FIG. 2). Although operation of the shutter 1 is described in greater detail below, it should be observed immediately that the depth of the housing 22 is advantageously greater than the axial extent of the side wall 11 of the shutter 1. This enables the shutter to be slightly deformed when it is fitted into the housing 22. This guarantees that the end wall 10 of the shutter 1** is in relatively well sealed contact with the pusher 2. Substance running out from the outlet channel 23 thus penetrates preferably into the slot 12 rather than running between the end wall 10 and the pusher 2.

The perspective view of FIG. 4 shows another dispenser head. It differs from the preceding head in the direction in which the substance is delivered. In the previous head it was delivered axially and in the new head dispensing takes place laterally. As shown in the section of FIG. 5, this is achieved in conventional manner by means of a pusher 2 having an L-shaped outlet channel 23. Beyond the narrowing of its section which provides the abutment required by the rod 30 of the valve 3 engaged on the axis of the pusher 2, the channel 23 extends radially. It terminates in an extension of rectangular section projecting from the outside wall of the pusher 2. A second embodiment of a shutter 1 in accordance with the invention is fitted over this extension.

This second shutter 1 is somewhat different from the first shutter described above. It is made from the same resiliently deformable material, and it similarly comprises an end wall 10 and a side wall 11. In this case the side wall defines a rectangular wall suitable for engaging in a complementary housing 22 formed around the lateral extension on the pusher 2. The radial extent of the housing 22 is equal in this case to that of the wall 11 of the shutter 1 so as to ensure continuity with the thrust surface 20 of the pusher. As in the preceding case, the end wall 10 is pierced by a slot 12. On the inside surface 210*i* of the end wall 10, the slot is identical in size to the outlet channel 23. It retains this size along substantially all of its extent in the substance-dispensing direction, and it is narrowed to a slit only at its outside end. In the drawings, the slit is shown as extending parallel to the thrust surface 20 of the pusher 2.

Figure 8:
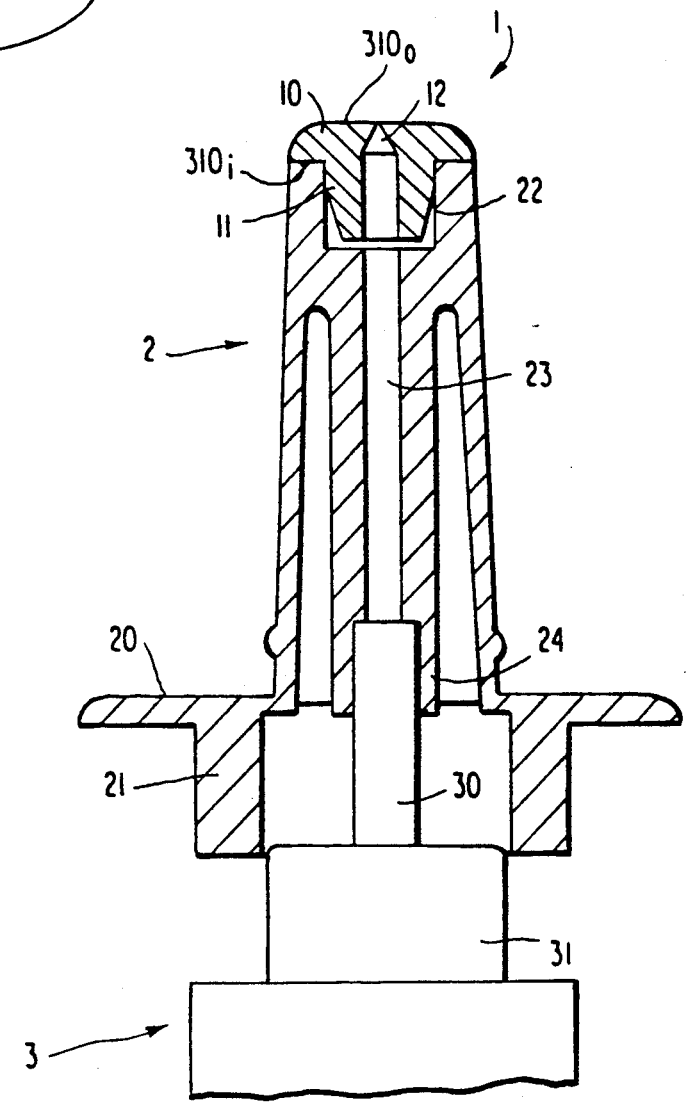

FIG. 7 is a perspective view of a dispenser head which provides axial delivery of the substance as in the case of FIG. 1, but is of a different shape. It is designed to be inserted into a cavity so that the substance is deposited into the depth of the cavity. To this end, the corresponding pusher 2 is conventionally extended by a narrow tapering truncated cone fitted with two radial fins constituting the thrust surface 20. The outlet channel 23 extends along the truncated cone between the narrowing that provides the abutment for the hollow rod 30 and the housing 22 for receiving the shutter 1 (see FIG. 8).

As in the preceding embodiments, this third embodiment of the present shutter made of resiliently deformable material comprises an end wall 10 and a side wall 11. However, in this case the side wall is cylindrical and is adapted to be received in the housing 22. Unlike the embodiment shown in FIG. 2, engagement between shutter 1 and housing 22 of pusher 2 takes place in this embodiment via the outside surface of the side wall 11, only. The shutter 1 is advantageously a force-fit in the housing 22 so as to constitute not only a good seal but also to ensure that the shutter 1 is firmly retained throughout the lifetime of the dispenser head. This is particularly desirable since the axial extent of the side wall 11 is less than that of the housing 22, as is the case in the first above-described shutter, and consequently substance may penetrate into the intermediate space that remains and tend to expel the shutter 1. It is nevertheless advantageous to leave such a gap in order to ensure good contact between the pusher 2 and the end wall 10 by prior deformation. In this case, the end wall extends beyond the side wall 11. As its inside surface 310*i* contacts the housing edge, it provides a limit on the depth to which the shutter can be forced into the housing. This also increases sealing in this form of fitting.

In this case, the slot 12 going through the end wall 10 of the shutter appears on the outside surface 310*o* of the shutter in the form of a cross-shaped slit. It flares inwardly to occupy a cylindrical section which is advantageously identical to the section of the outlet channel 23 through the pusher 2.

The person skilled in the art will understand that all three shutter shapes described in detail above are not necessarily associated with the pushers described at the same time. Indeed, they are interchangeable to a greater or lesser extent depending on the space available for fitting the shutter to the pusher, on the consistency of the substance to be dispensed, on the volume of a single dose, etc. For example, the shutter described with reference to FIGS. 7 and 8 appears to be better adapted to an elongate pusher whose tip is too small to provide a housing 22 capable of receiving and engaging both the inside and the outside surfaces of the side wall. Simultaneously, this type of pusher is effective only when the substance is relatively liquid and is capable of running along an outlet channel 23 which is both narrow and long. Under such circumstances, the shutter 1 with a small-sized slot 12 is sufficient for adequate dispensing.

This leads on to the method of operation of shutters of the present invention. When the dispensing valve 3 is at rest, the resilience of the shutter material contributes to obtaining sealed closure of the outer slit therein. Thus, all of the substance contained in the outlet channel 23 of any of the various pushers 2 is protected from ambient air and therefore does not run the risk of drying out, of oxidizing, or of being contaminated. However, when the dispenser is actuated and the valve 3 opens, new quantities of substance penetrate into the outlet channel 23. This means that the valve 3 delivers substance at a relatively higher pressure. It thus constitutes a pump, unless the supply of the dispenser is itself under pressure. The pressure is then applied against the inside of the slot 2 through the shutter 1. The tapering section thereof thus causes the lips of the outer slit to spread apart. Substance can then escape to the outside for as long as sufficient pressure is maintained. Depending on the consistency of the substance, the dose delivered in this way either flows away in a stream or collects as a large drop. In this context, the first embodiment described above is better adapted to dispensing large drops while the other two embodiments are better for dispensing streams. In either case, once the associated dispensing heads are no longer actuated, the shutters re-establish the desired isolation of the outlet channel 23.

In other words, the present shutter is, in effect, a non-return valve for controlling delivery to the outside of semi-liquid substances under pressure. It is therefore particularly advantageous to associate such a shutter with a valve 3 such as that shown in axial section in FIG. 9. In this figure, there can be seen means for fixing the valve 3 (constituted in this case by a metal crimping ring 31 and an associated annular gasket 33) and the hollow rod 30 as described above. However, the section also shows a cylindrical pump body 37 whose top end is open and whose bottom end narrows to constitute a seat for a ball 38. The ball 38 is retained by radial fingers 43 integral with the pump body 37 and co-operating with the narrowing to constitute a housing in which the ball is held captive. Beneath its narrowing, the pump body 37 is extended by a sleeve 40 which may be engaged in a dip tube 41, where appropriate.

In addition, the hollow rod 30 is formed integrally with a piston 34 having a peripheral sealing lip 35 adapted to travel over the inside surface of the pump body 37. A return spring 36 extends inside the pump body 37 between its bottom narrowing and the piston 34. The spring thus opposes lowering of the piston 34. However, the piston may be lowered by applying external thrust, since sufficient clearance is maintained between the rod 30 and the crimping ring 31 to enable air to penetrate into the pump body 37 above the piston 34. Where necessary, air can be allowed to penetrate freely into the container containing the supply of substance (not shown) through an opening 39. This opening 39 is formed through the pump body 37 and opens out beneath the sealing gasket 33. However, when the piston 34 is in its rest position such communication is closed off by means of a second gasket 32 disposed against the open end of the pump body 37 and beneath the ring 31. The piston 34 includes an axially-extending crown 44 that bears against the gasket 32.

Figure 9:
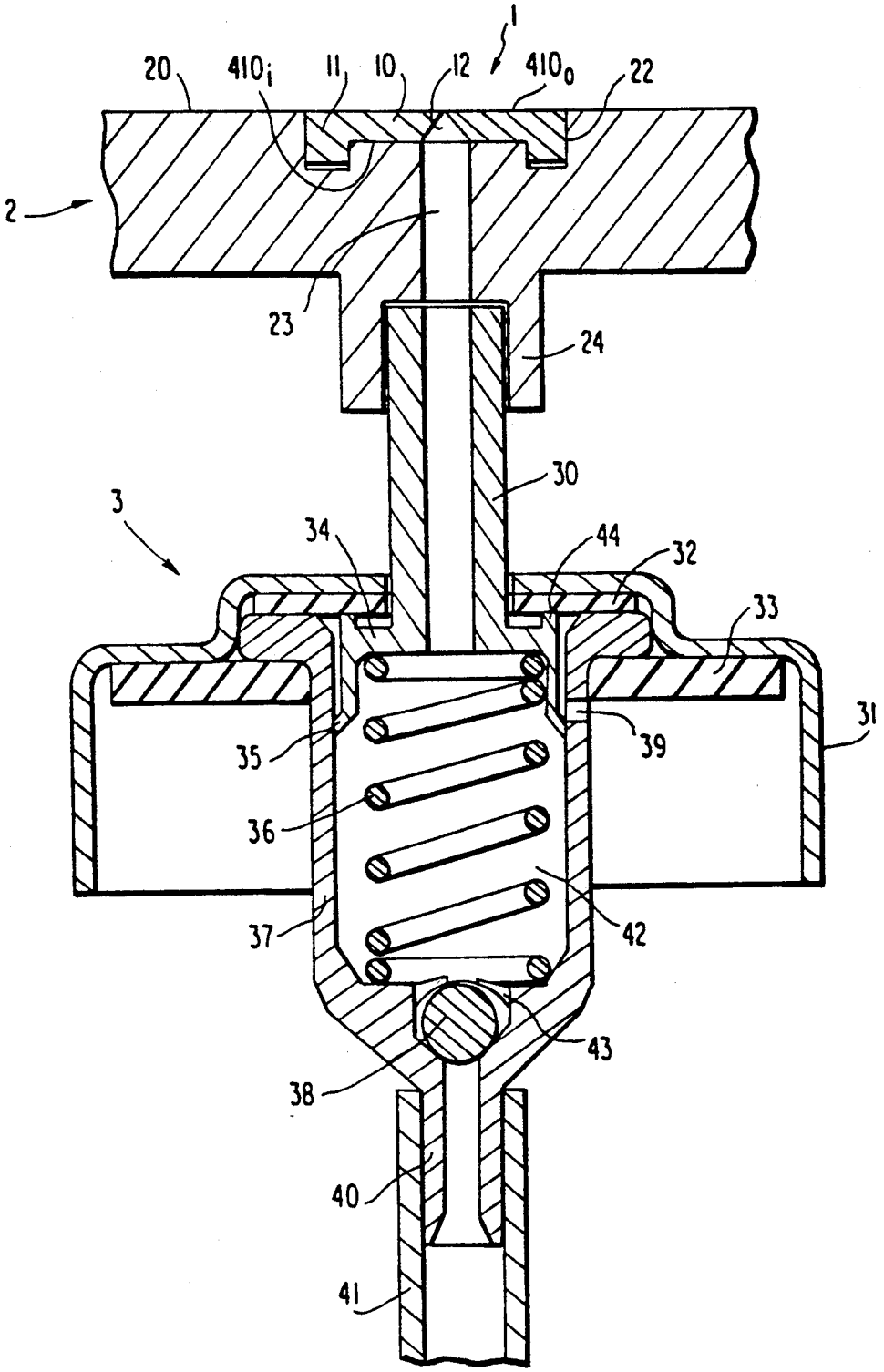
FIG. 9 is an axial section through an embodiment of an advantageous dispenser head in accordance with the present invention.

Finally, FIG. 9 shows a portion of a pusher 2 associated with this special valve 3. The pusher 2 includes a hollow cylinder 24 suitable for receiving the end of the hollow rod 30. An outlet channel 23 then looks into the bore of the rod 30, thereby simultaneously providing the rod 30 with an abutment against the pusher and providing continuous communication between the pump body 37 and the delivery orifice. The delivery orifice is constituted by the slit provided on the outside face $410_o$, of the end wall 10 of a shutter 1 in accordance with the present invention. By way of example, this shutter may be identical to that described above with reference to FIGS. 1 to 3.

When a user presses down on the thrust surface 20 of the pusher 2, the volume of the pump chamber in the valve 3 is reduced, which volume is constituted by the total inside space of the outlet channel 23, the hollow rod 30, and the pump body 37. Providing this space is already full of substance, then the substance is rapidly put under pressure since the ball 38 prevents it from being driven back into the supply (not shown).

This deforms the slot 12 in the shutter 1 as described above. Substance is thus delivered through the slit of the shutter 1 to the outside of the dispenser head. Substance may continue to be delivered in this way until the piston 34 encounters the bottom of the pump body 37. However, dispensing may be stopped as soon as the user ceases to apply pressure. In any event, once the piston 34 stops, the pressure required for deforming the slot 12 no longer exists in the substance, and as a result the shutter 1 closes under its own resilience which guarantees sealing from the atmosphere. The pump chamber is thus isolated from ambient air.

When the return spring 36 begins to return the piston 34 to its high position, the volume of the chamber increases, thereby establishing suction capable of raising the ball 38 off its seat and sucking up substance from the supply (not shown). As a result, the chamber is filled with a new quantity of substance which can be dispensed by subsequent actuation as described above.

The valve 3 as described above is not optimal with respect to priming or with respect to its need to be in the vertical position to ensure proper operation. However, these various deficiencies are easily rectified by technical equivalents applicable, inter alia, to the admission system to the pump chamber. It should be observed that such equivalents are completely independent from the present shutter whose advantage is to provide an outlet valve for the pump chamber which is both extremely easy to provide and is favorably positioned at the outlet orifice itself. It is this characteristic of the valve 3 that constitutes subject matter of the present invention. The person skilled in the art will thus understand that the example described herein with reference to FIG. 9 is applicable to any type of metering pump valve having a pump chamber suitable for association with the present shutter as its outlet valve.

I claim:

1. A dispenser head particularly adapted for delivering a semi-liquid substance at a pressure greater than atmospheric pressure, said dispenser head having an outlet channel, characterized in that said outlet channel is closed by a shutter, said shutter being made of a resiliently deformable material and including a perforation having lips that press against each other in sealed manner at rest, said shutter having an end wall with an inside surface and an outside surface, and a side wall extending from said inside surface of said end wall, said perforation being formed through said end wall and being constituted by a slot having its maximum width adjacent said inside surface and narrowing to a slit adjacent said outside surface, said shutter being engaged in a housing formed in said head in such a manner that:

a) said slot communicates with said outlet channel, said slit being at the outside of said dispenser head such that said substance dispensed under pressure exerts a force on the walls of said slot, thereby deforming the shutter and causing the slit to open; and b) said head is in sealed contact with said side wall over a first surface and is in sealed contact with said inside surface of said end wall over a second surface, said first and second surfaces being such that no communication is possible between said outlet channel and the outside via said shutter other than through said perforation;

wherein said first surface extends only over the inside of said side wall.

2. A dispenser head particularly adapted for delivering a semi-liquid substance at a pressure greater than atmospheric pressure, said dispenser head having an outlet channel, characterized in that said outlet channel is closed by a shutter, said shutter being made of a resiliently deformable material and including a perforation having lips that press against each other in sealed manner at rest, said shutter having an end wall with an inside surface and an outside surface, and a side wall extending from said inside surface of said end wall, said perforation being formed through said end wall and being constituted by a slot having its maximum width adjacent said inside surface and narrowing to a slit adjacent said outside surface, said shutter being engaged in a housing formed in said head in such a manner that:

a) said slot communicates with said outlet channel, said slit being at the outside of said dispenser head such that said substance dispensed under pressure exerts a force on the walls of said slot, thereby deforming the shutter and causing the slit to open; and b) said head is in sealed contact with said side wall over a first surface and is in sealed contact with said inside surface of said end wall over a second surface, said first and second surfaces being such that no communication is possible between said outlet channel and the outside via said shutter other than through said perforation;

wherein said end wall is limited by said side wall and said second surface extends over a portion of said inside surface of said end wall lying within said side wall.

3. A dispenser head particularly adapted for delivering a semi-liquid substance at a pressure greater than atmospheric pressure, said dispenser head having an outlet channel, characterized in that said outlet channel is closed by a shutter, said shutter being made of a resiliently deformable material and including a perforation having lips that press against each other in sealed manner at rest, said shutter having an end wall with an inside surface and an outside surface, and a side wall extending from said inside surface of said end wall, said perforation being formed through said end wall and being constituted by a slot having its maximum width adjacent said inside surface and narrowing to a slit adjacent said outside surface, said shutter being engaged in a housing formed in said head in such a manner that:

a) said slot communicates with said outlet channel, said slit being at the outside of said dispenser head such that said substance dispensed under pressure exerts a force on the walls of said slot, thereby deforming the shutter and causing the slit to open; and b) said head is in sealed contact with said side wall over a first surface and is in sealed contact with said inside surface of said end wall over a second surface, said first and second surfaces being such that no communication is possible between said outlet channel and the outside via said shutter other than through said perforation;

wherein said end wall extends beyond said side wall and said second surface extends over a portion of said inside surface of said end wall surrounding said side wall.

* * * * *